US010557238B2

(12) United States Patent
Lee

(10) Patent No.: US 10,557,238 B2
(45) Date of Patent: Feb. 11, 2020

(54) LOST SAND COLLECTING APPARATUS FOR PREVENTING COASTAL EROSION

(71) Applicant: HAN OCEAN CO., LTD, Busan (KR)

(72) Inventor: Gwang Soo Lee, Busan (KR)

(73) Assignee: HAN OCEAN CO., LTD (KR)

( * ) Notice: Subject to any disclaimer, the term of this patent is extended or adjusted under 35 U.S.C. 154(b) by 0 days.

(21) Appl. No.: 16/090,052

(22) PCT Filed: Mar. 14, 2017

(86) PCT No.: PCT/KR2017/002711

§ 371 (c)(1),
(2) Date: Sep. 28, 2018

(87) PCT Pub. No.: WO2017/171268

PCT Pub. Date: Oct. 5, 2017

(65) Prior Publication Data

US 2019/0112770 A1 Apr. 18, 2019

(30) Foreign Application Priority Data

Apr. 1, 2016 (KR) ..... 10-2016-0040428

(51) Int. Cl.
*E02B 3/06* (2006.01)
*E02B 3/14* (2006.01)

(52) U.S. Cl.
CPC . *E02B 3/06* (2013.01); *E02B 3/14* (2013.01)

(58) Field of Classification Search
CPC ..... E02B 3/04; E02B 3/14; E02B 3/06; E02B 3/043; E02D 17/20; Y10T 428/24157; E01C 11/185
See application file for complete search history.

(56) References Cited

U.S. PATENT DOCUMENTS 3,990,247 A * 11/1976 Palmer ..... E02B 3/14 405/16
4,498,805 A * 2/1985 Weir ..... E02B 3/06 405/31

(Continued)

FOREIGN PATENT DOCUMENTS

EP 0378309 A1 7/1990
JP 02229303 A 9/1990

(Continued)

*Primary Examiner* — Carib A Oquendo
(74) *Attorney, Agent, or Firm* — Faegre Baker Daniels LLP

(57) ABSTRACT

A lost sand collecting apparatus, according to the present invention, comprises: a filling frame which has a plurality of plates, extends in the lateral direction and forms a plurality of filling spaces; and a collecting means which is provided on the filling frame and is positioned so as to correspond to the filling spaces. The plurality of plates are overlapped so as to be parallel to each other and the plates adjacent with a fixed distance therebetween are partly connected to one another. The collecting means can be formed in a flat structure protruding upward from the filling frame and disposed on the back of the filling spaces with respect to the littoral current toward the sea, and comprises a barrier layer or a web layer. The barrier layer or the web layer is curved toward the littoral current toward the sea. According to the present invention, the collecting means enables inhibition of the flow of the littoral current toward the sea and collection of sand moving with the littoral current flowing from the shore to the sea, thereby regulating coastal erosion. Therefore, coastal beaches can be preserved.

4 Claims, 7 Drawing Sheets

(56) References Cited

U.S. PATENT DOCUMENTS

| | | | | |
|---|---|---|---|---|
| 5,449,542 | A * | 9/1995 | Chiba | E04B 2/92 428/116 |
| 8,747,023 | B1 * | 6/2014 | Walker | E02B 3/06 405/107 |
| 2012/0315089 | A1 * | 12/2012 | Burns | E02D 31/002 405/16 |
| 2013/0209178 | A1 * | 8/2013 | Erez | E02D 17/202 405/302.7 |
| 2016/0312427 | A1 * | 10/2016 | De Groot | E02B 3/14 |
| 2019/0048546 | A1 * | 2/2019 | Anh | E02B 7/40 |

FOREIGN PATENT DOCUMENTS

| | | | |
|---|---|---|---|
| JP | 10331126 | A | 12/1998 |
| JP | 2015048619 | A | 3/2015 |
| KR | 20-0383918 | | 5/2005 |
| KR | 10-0657180 | B1 | 12/2006 |
| KR | 10-2010-0116895 | A | 11/2010 |
| KR | 10-1260643 | B1 | 5/2013 |
| WO | 2006112579 | A | 10/2006 |

* cited by examiner

【Figure 1】
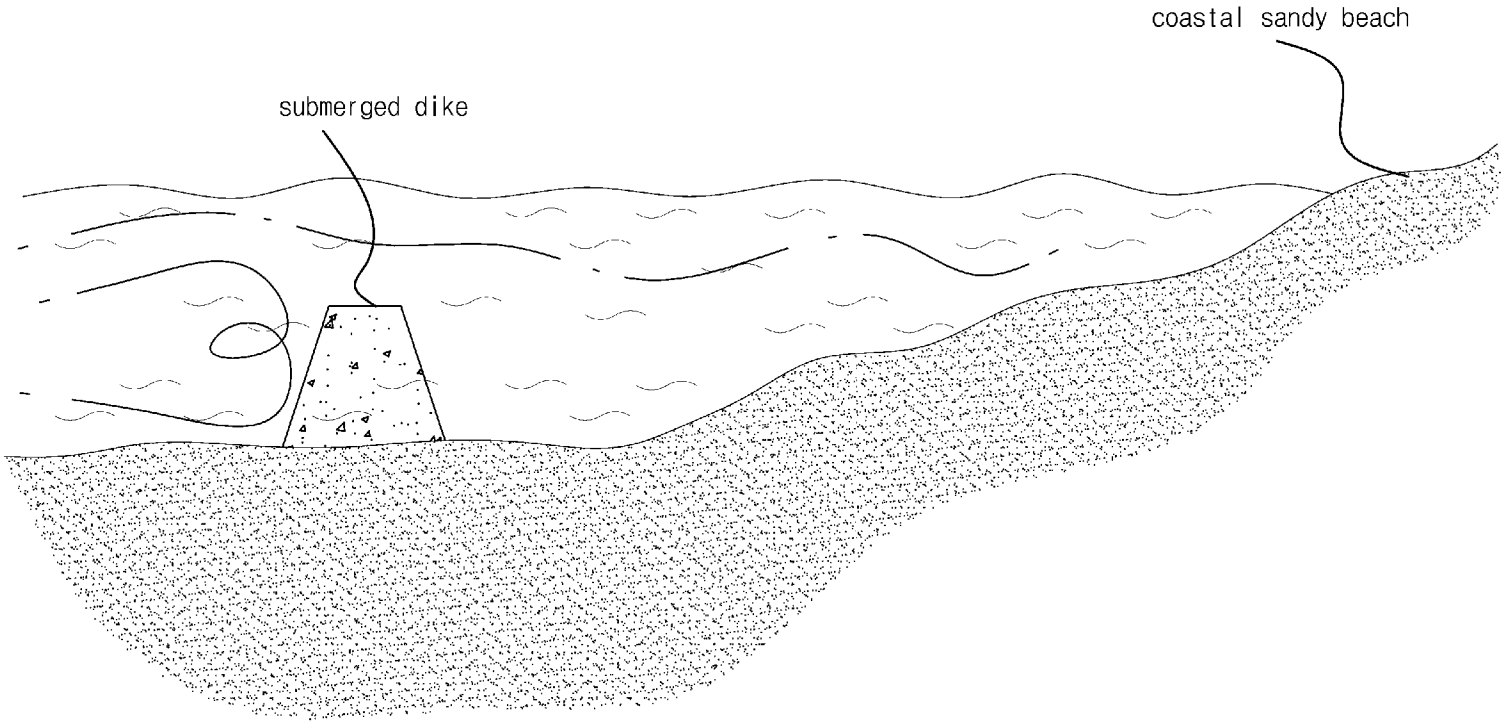

【Figure 2】
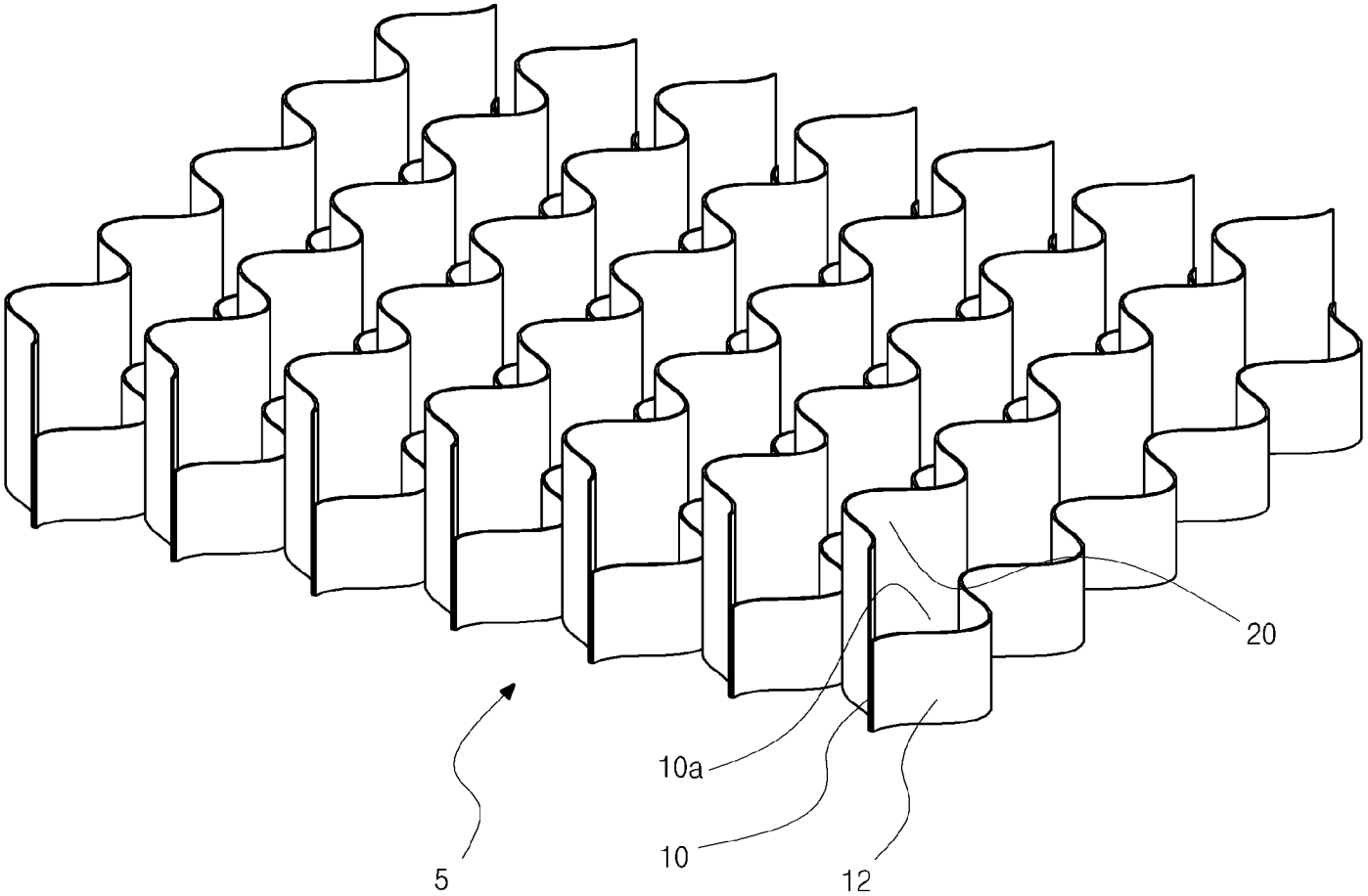

【Figure 3】
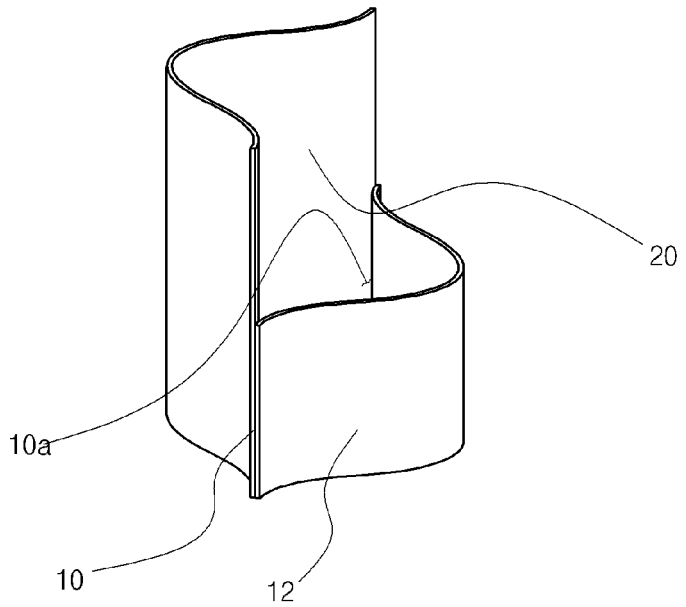
【Figure 4】
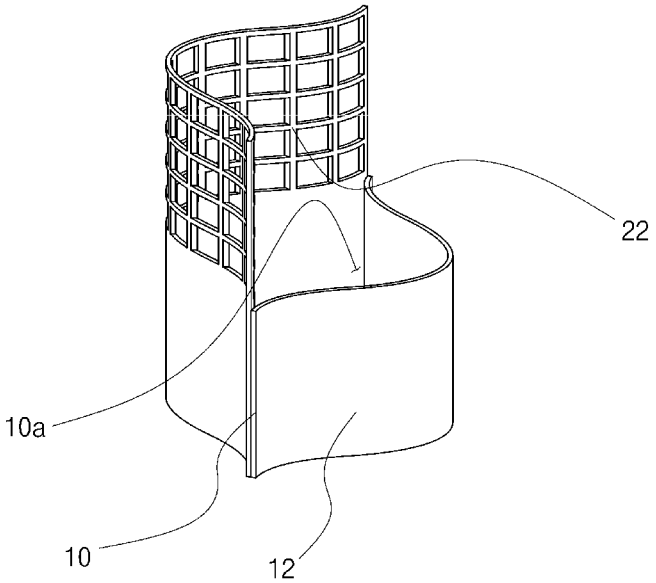

【Figure 5】
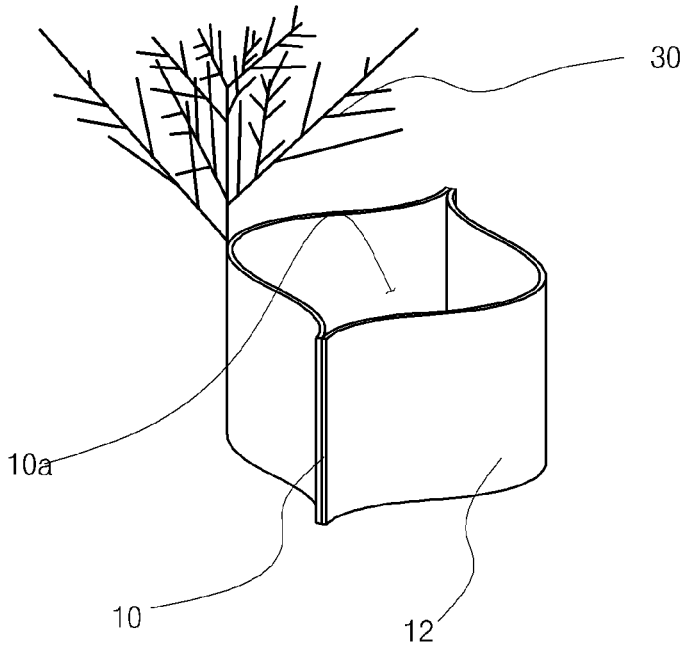
【Figure 6】
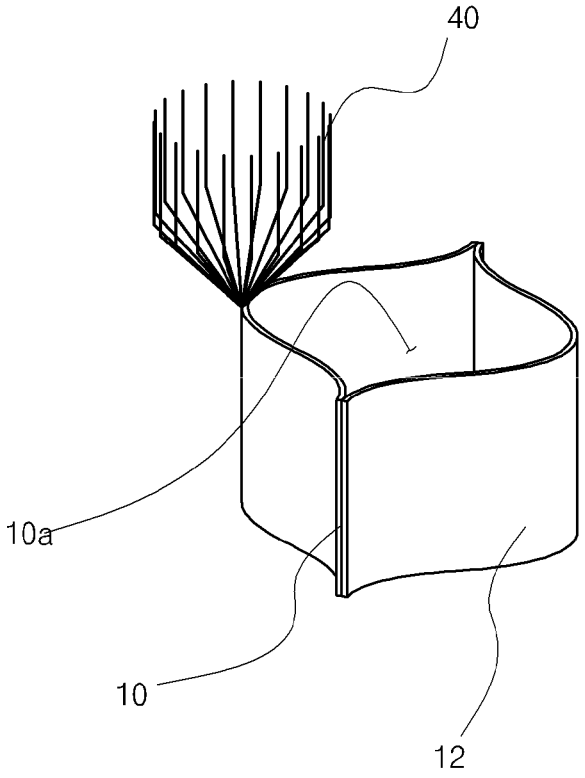

【Figure 7】
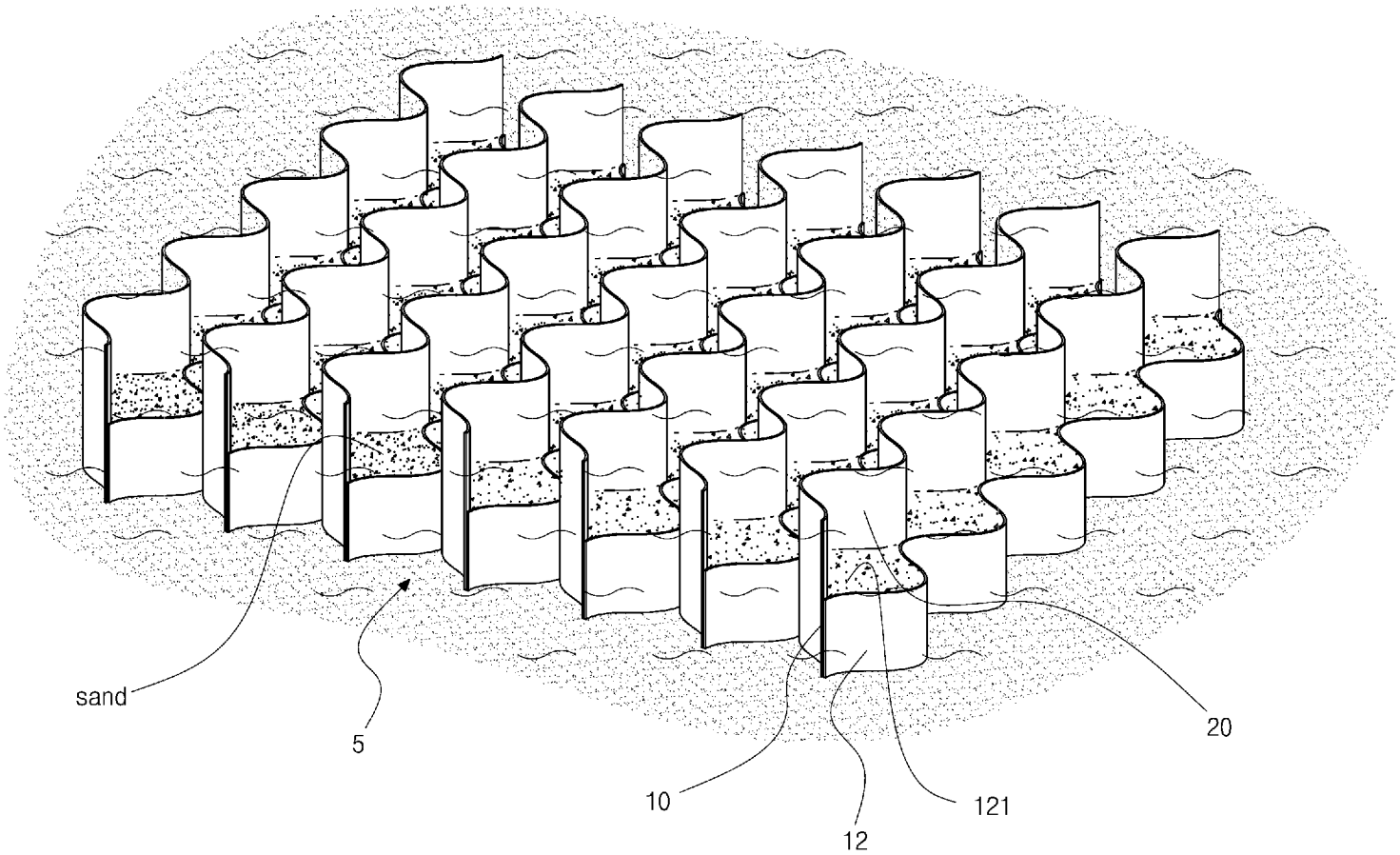

【Figure 8】
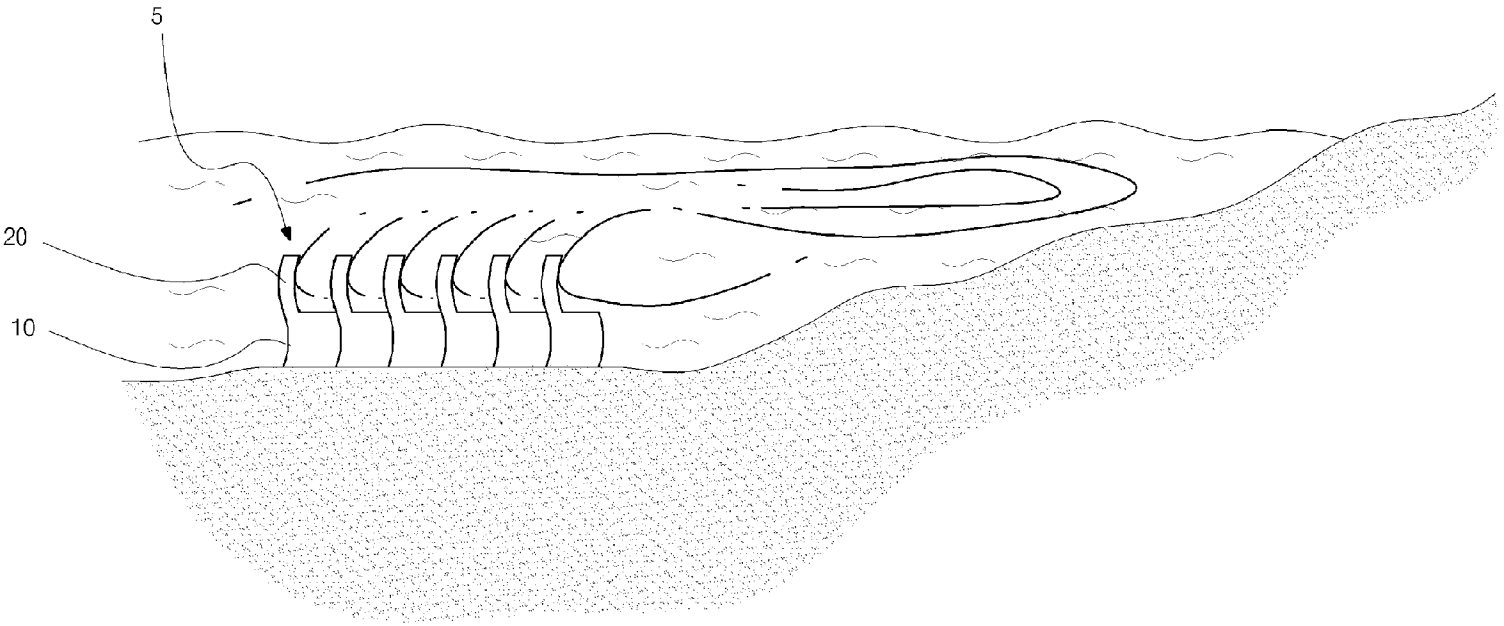

【Figure 9】
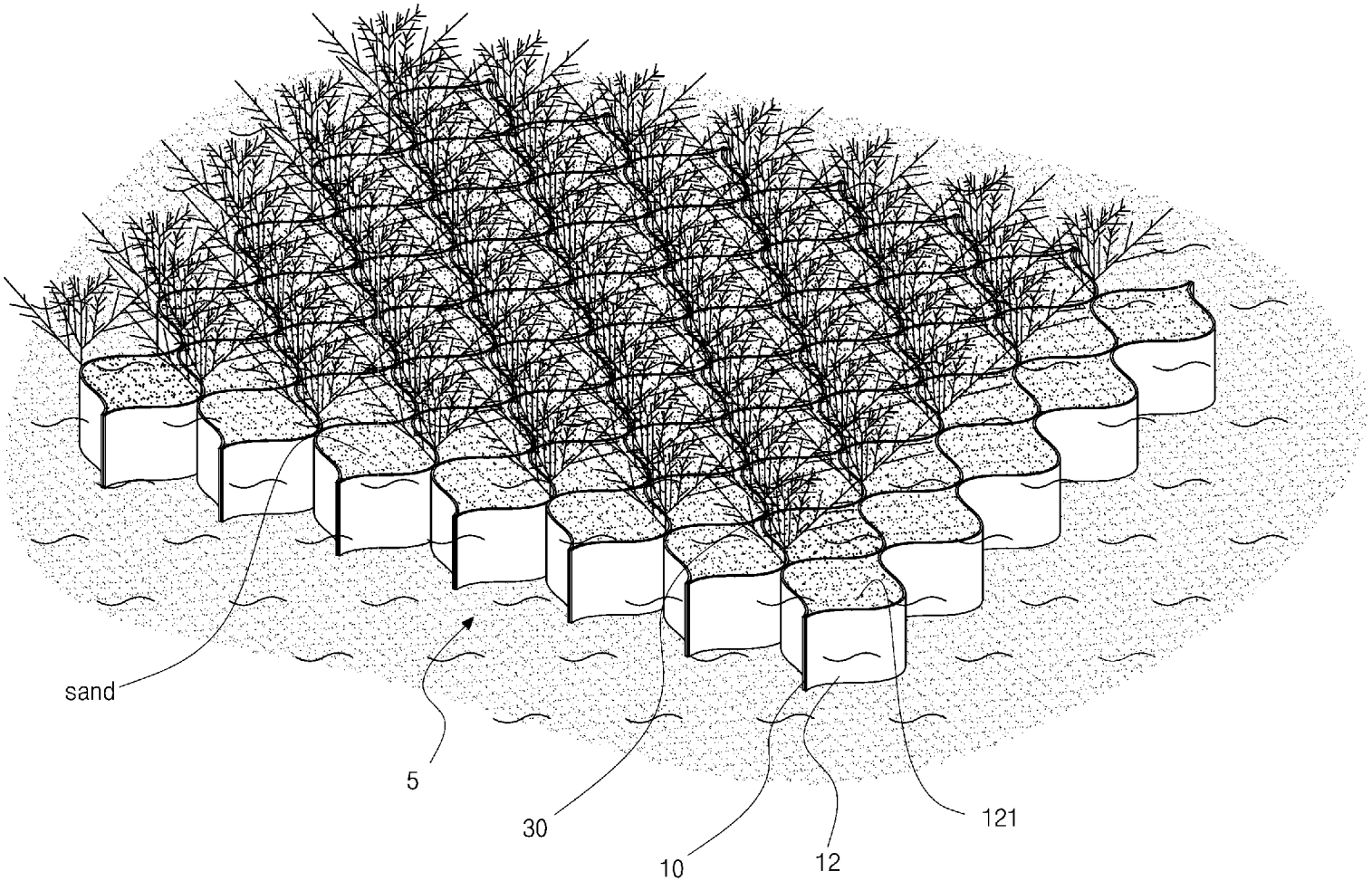

LOST SAND COLLECTING APPARATUS FOR PREVENTING COASTAL EROSION

CROSS-REFERENCE TO RELATED APPLICATIONS

This application is a U.S. National Phase filing of PCT/KR2017/002711, filed Mar. 14, 2017, which claims the benefit of Korean Application No. 10-2016-0040428, filed Apr. 1, 2016, the entire disclosures of both of which are hereby expressly incorporated by reference herein.

TECHNICAL FIELD

The present invention relates to a lost sand collecting apparatus for preventing coastal erosion and relaxing an inclination of a submarine sand slope by collecting sands to be lost by a wave.

BACKGROUND ART

A coastal sandy beach is formed due to sedimentation of sands supplied from a river of land and a coastal sand dune, and the like. In a natural state, the sandy beach is maintained while a phenomenon in which the supplied sands are accumulated on a coast is balanced with a phenomenon in which sands are lost toward the sea by a wave.

Meanwhile, the coastal sandy beach is becoming important as a tourism resource due to environmental conservation as well as the popularity of various marine sports. However, since a riverside is reclaimed or blocked by a concrete embankment due to a river maintenance project, a natural green area is reduced due to an urban facility construction, and a coastal sand dune is reclaimed to be disappeared, an amount of sands introduced into the sea is abruptly reduced, resulting in a reduction in the coastal sandy beach.

Therefore, various methods of preventing the reduction in the coastal sandy beach have been attempted. In examples of such a method, there is a so-called wave breaking method in which an artificial structure is installed to block or attenuate influence of a wave, and there is an artificial nourishment method in which sands of other regions are transported and supplied to a sandy beach.

Here, the wave breaking method is classified into a submerged dike method in which a wave is suppressed by installing an underwater structure on a seafloor away from the coast to the sea and a revetment method in which influence of a wave is prevented from reaching a land side by installing a structure in the vicinity of the coast or inside the coast.

The submerged dike method is classified into, according to a shape of a structure, a method in which only a high wave is blocked using a structure, i.e., a submerged dike installed in an underwater (see FIG. 1) and a method in which all of a low wave and a high wave are blocked using a structure, i.e., an offshore breakwater protruding from a water surface by a certain height.

Meanwhile, in the related art, in the case of the wave breaking method, erosion of a coast is prevented to a certain degree. However, phenomena such as scouring of a beach or an advance and a retreat of a coastline are caused according to the shape and position of the structure, resulting in deformation of the coastline.

In addition, since the submerged dike and the offshore breakwater require enough rigidity not to be swept away by a sea current or a wave, most of the submerged dike and the offshore breakwater are formed as a concrete structure so as to satisfy such a condition. Such underwater structures do a disservice to sailing of a vessel and also have an adverse effect on activation of marine sports.

According to the revetment method, since a wave is pushed to a revetment and generates erosion of an entire surface of the revetment, it is impossible to prevent loss of sands.

In the artificial nourishment method of artificially introducing sands, since many costs are required for collecting and transporting sands and the artificial nourishment method is not a fundamental measure to prevent loss of sands, there is a burden of continuously supplying the sands.

DISCLOSURE

Technical Problem

The present invention has been made keeping in mind the above problems encountered in the related art and is directed to providing a lost sand collecting apparatus capable of effectively suppressing erosion of a coast by collecting sands to be swept away by a near shore current.

Technical Solution

In order to achieve the purposes, a lost sand collecting apparatus according to the present invention includes: a filling frame which has a structure in which a plurality of plates are disposed in parallel to overlap each other at certain intervals in a longitudinal direction thereof and adjacent plates are partially attached to each other, wherein the filling frame extends in a lateral direction thereof to form a plurality of filling spaces; and collecting units which are provided on the filling frame and are each disposed to correspond to one of the filling spaces.

The collecting unit may be formed in a planar structure form which protrudes in an upward direction from the filling frame and is formed in the rear of the filling space of the filling frame with respect to a direction of a near shore current flowing from a coast to a sea. In this case, the collecting unit may be formed as a blocking membrane or a mesh membrane.

Here, the blocking membrane or the mesh membrane may be formed in a shape curved in a direction opposite to the near shore current flowing from the coast to the sea.

The collecting unit may be formed in a three-dimensional structure form which protrudes in an upward direction from the filling frame and is disposed in the rear of the filling space of the filling frame with respect to the near shore current flowing from the coast to the sea.

In this case, the collecting unit may be formed as an aquatic plant model body or a brush-shaped body.

Advantageous Effects

As described above, according to a lost sand collecting apparatus according to the present invention, a near shore current is suppressed from flowing from a coast to a sea by a collecting unit, and sands moved by the near shore current are collected to mitigate erosion of the coast, thereby assisting conservation of a sandy beach.

In addition, the lost sand collecting apparatus according to the present invention does not do a great disservice to activities of marine sports due to characteristics of a shape and a material thereof. When the collecting unit is formed as an aquatic plant model body, the collecting apparatus rather has characteristics of being eco-friendly according to a type thereof and also assists activities of marine sports.

DESCRIPTION OF DRAWINGS

FIG. 1 is an example view illustrating a conventional configuration for preventing erosion of a coast (submerged dike method).

FIG. 2 is a perspective view illustrating an overall shape of a lost sand collecting apparatus according to the present invention.

FIG. 3 is a perspective view illustrating a collecting unit applied to the lost sand collecting apparatus according to the present invention (blocking membrane).

FIG. 4 is a perspective view illustrating a collecting unit applied to the lost sand collecting apparatus according to the present invention (mesh membrane).

FIG. 5 is a perspective view illustrating a collecting unit applied to the lost sand collecting apparatus according to the present invention (aquatic plant model body).

FIG. 6 is a perspective view illustrating a collecting unit applied to the lost sand collecting apparatus according to the present invention (brush-shaped body).

FIG. 7 is an example view illustrating an installation state of the lost sand collecting apparatus according to the present invention (blocking membrane collecting unit).

FIG. 8 is an example view illustrating operation of the lost sand collecting apparatus according to the present invention (blocking membrane collecting unit).

FIG. 9 is an example view illustrating an installation state of the lost sand collecting apparatus according to the present invention (aquatic plant model body collecting unit).

MODES OF THE INVENTION

Hereinafter, specific content for practicing the present invention will be described in detail with reference to FIGS. 2 to 9.

As shown in FIG. 2, a lost sand collecting apparatus 5 according to the present invention includes a filling frame 10 which has a structure in which a plurality of plates 12 are disposed in parallel to overlap each other at certain intervals in a longitudinal direction thereof and adjacent plates are partially attached to each other, wherein the filling frame 10 extends in a lateral direction thereof to form a plurality of filling spaces 10*a*, and collecting units which are provided on the filling frame 10 and are each disposed to correspond to each of the filling spaces 10*a*.

The collecting unit may protrude upward from the filling frame 10 and be disposed in the rear of the filling space 10*a* of the filling frame 10 with respect to a direction of a near shore current flowing from a coast to a sea and may be classified into a planar structure form and a three-dimensional structure form according to morphological characteristics.

As shown in FIGS. 3 and 4, an example of the collecting unit having the planar structure form may include a blocking membrane 20 or a mesh membrane 22.

The blocking membrane 20 and the mesh membrane 22 may be integrally formed with the filling frame 10 so as to extend in an upward direction from a partial section of an upper end of the filling frame 10 or may be manufactured separately from the filling frame 10 and be attached to the filling frame 10.

Here, the blocking membrane 20 and the mesh membrane 22 may be connected to an edge of the upper end of the filling frame 10 in deed irrespective of a configuration manner thereof and thus may be formed in a shape curved in a direction opposite to the near shore current flowing from the coast to the sea.

As examples shown in FIGS. 5 and 6, the collecting unit having the three-dimensional structure form may include an aquatic plant model body 30, a brush-shaped body 40, or the like. The aquatic plant model body 30 is formed in a shape similar to an aquatic plant such as coral or seaweed which actually lives in the sea. The brush-shaped body 40 is formed in a shape in which vertically elongated linear members are clustered.

In such a configuration of the lost sand collecting apparatus 5 according to the present invention, the filling frame 10, the blocking membrane 20, and the mesh membrane 22 are made of a flexible synthetic resin material so as to be easily manufactured, transported, and installed.

The aquatic plant model body 30 and the brush-shaped body 40 are not limited to a material but may also be made of a flexible synthetic resin material.

Operation of the lost sand collecting apparatus according to the present invention as configured above will be described as follows.

First, the lost sand collecting apparatus 5 according to the present invention is widely installed to cover a certain area of a seafloor located at a certain distance from the coast to the sea, and the area and form in which the collecting apparatus is installed may be changed according to the size and form of a coast (see FIG. 7).

In addition, in order to effectively prevent erosion of a seafloor, the lost sand collecting apparatus 5 according to the present invention may be installed in a region where loss of sands is serious due to an influence of a wave.

Here, the lost sand collecting apparatus 5 according to the present invention may be installed through various methods. For example, the collecting apparatus 5 may be mounted through a method of digging a seafloor to a certain depth, installing a nonwoven fabric, and then widely spreading the filling frame 10 on the nonwoven fabric to form the filling spaces 10*a* (not shown).

The lost sand collecting apparatus 5 may be installed through a simple method of spreading and mounting the filling frame 10 on a seafloor according to topography of the seafloor, a working environment, and the like (see FIG. 7)

According to the present invention, as shown in FIG. 8, the collecting unit formed on the filling frame 10 acts as a resistance element which resists a flow of a near shore current formed above the filling frame 10, and thus, the near shore current is suppressed from flowing from the coast to the sea.

In addition, some of sands, which are swept away by the near shore current flowing from the coast to the sea, strikes against the collecting apparatus 5, and stagnates to flow into and fill the filling spaces 10*a* of the filling frame 10 or flows again toward the coast due to a wave flowing toward the coast and sinks, so that erosion of a sand beach is mitigated.

Here, a resistance operation against the near shore current flowing from the coast to the sea may be considered to be more effectively performed due to the collecting unit having the planar structure form such as the blocking membrane 20 and the mesh membrane 22. A collection operation for sands may be considered to be more effectively performed due to the collecting unit having the three-dimensional structure form such as the aquatic plant model body 30 and the brush-shaped body 40.

As described above, the lost sand collecting apparatus 5 according to the present invention may function to weaken influence of a wave like a conventional submerged dike or groin and may also collect sands to be swept away from a coast to actively prevent an erosion phenomenon of the coast.

In particular, when the collecting unit of the lost sand collecting apparatus 5 of the present invention is formed as the aquatic plant model body 30, the collecting apparatus 5 may eco-friendly harmonize with a surrounding marine environment without morphologically retaining a sense of difference with the surrounding marine environment, thereby assisting activities such as marine sports (scuba diving) (see FIG. 9).

In addition, the lost sand collecting apparatus 5 according to the present invention is installed in water like the conventional submerged dike but does not do a great disservice to sailing of a vessel because a material thereof is a flexible synthetic resin material.

The invention claimed is:

1. A lost sand collecting apparatus comprising:

a filling frame which has a structure in which a plurality of plates are disposed in parallel to overlap each other at certain intervals in a longitudinal direction thereof and adjacent plates are partially attached to each other, wherein the filling frame extends in a lateral direction thereof to form a plurality of filling spaces, the filling frame relative to a respective filling space has a front portion and a rear portion, the rear portion extending higher than the front portion; and collecting units which are provided on the filling frame and are each disposed to correspond to one of the filling spaces, wherein sands moved by a near shore current flowing from a coast to a sea above the filling frame are collected by the collecting units, wherein the collecting units are formed in a planar structure form which protrudes in an upward direction from the filling frame and is formed in the rear of the filling space of the filling frame with respect to a direction of the near shore current flowing from the coast to the sea.

2. The lost sand collecting apparatus of claim 1, wherein the collecting unit is formed as a blocking membrane, the blocking membrane being formed in a shape curved in a direction opposite to the near shore current flowing from the coast to the sea.

3. The lost sand collecting apparatus of claim 1, wherein the collecting unit is formed as a mesh membrane, the mesh membrane being formed in a shape curved in a direction opposite to the near shore current flowing form the coast to the sea.

4. A lost sand collecting apparatus comprising:

a filling frame which has a structure in which a plurality of plates are disposed in parallel to overlap each other at certain intervals in a longitudinal direction thereof and adjacent plates are partially attached to each other, wherein the filling frame extends in a lateral direction thereof to form a plurality of filling spaces, the filling frame relative to a respective filling space has a front portion and a rear portion, the rear portion extending higher than the front portion; and collecting units which are provided on the filling frame and are each disposed to correspond to one of the filling spaces, wherein sands moved by a near shore current flowing from a coast to a sea above the filling frame are collected by the collecting units, wherein the collecting units are formed in a planar structure form which protrudes in an upward direction from the filling frame and is formed in the rear of the filling space of the filling frame with respect to a direction of the near shore current flowing from the coast to the sea.

* * * * *